US006736647B1

(12) United States Patent
Gillenberg

(10) Patent No.: US 6,736,647 B1
(45) Date of Patent: May 18, 2004

(54) PRINTED CIRCUIT BOARD CONNECTOR

(75) Inventor: Eric Gillenberg, Speyer (DE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/979,613

(22) PCT Filed: May 4, 2000

(86) PCT No.: PCT/EP00/03992

§ 371 (c)(1),
(2), (4) Date: Jun. 3, 2002

(87) PCT Pub. No.: WO00/69028

PCT Pub. Date: Nov. 16, 2000

(30) Foreign Application Priority Data

May 6, 1999 (DE) ..... 199 21 021

(51) Int. Cl.[7] ..... H01R 12/00
(52) U.S. Cl. ..... 439/65
(58) Field of Search ..... 439/65, 629–637, 439/62, 59, 61, 67, 79, 701, 682, 686, 687, 80, 283

(56) References Cited

U.S. PATENT DOCUMENTS

| | | | | |
|---|---|---|---|---|
| 3,955,875 A | | 5/1976 | Petiot | |
| 4,461,522 A | * | 7/1984 | Bakermans et al. | 439/79 |
| 4,552,420 A | | 11/1985 | Eigenbrode | |
| 4,836,791 A | * | 6/1989 | Grabbe et al. | 439/79 |
| 4,909,743 A | * | 3/1990 | Johnson et al. | 439/60 |
| 5,139,426 A | | 8/1992 | Barkus et al. | |
| 5,171,154 A | | 12/1992 | Casciotti et al. | |
| 5,397,241 A | | 3/1995 | Cox et al. | |
| 5,607,313 A | * | 3/1997 | Nyman | 439/83 |
| 5,816,831 A | | 10/1998 | Clark | |
| 5,975,920 A | * | 11/1999 | Oberstarr | 439/83 |
| 6,206,713 B1 | | 3/2001 | Baertsoen et al. | |

FOREIGN PATENT DOCUMENTS

| | | |
|---|---|---|
| WO | WO 97/17743 | 5/1997 |

OTHER PUBLICATIONS

Copy of International Search Reprot as issued in connection with the present PCT Application No. PCT/EP00/03992, dated Jul. 28, 2000.

* cited by examiner

*Primary Examiner*—Ross Gushi
(74) *Attorney, Agent, or Firm*—Baker & Daniels

(57) ABSTRACT

The circuit board edge connector described serves for connecting a first circuit board and a second circuit board adapted to be mated substantially vertically with said first circuit board, and is characterized in that that the part of the circuit board edge connector to be connected to the electrical connector located on one side of the second circuit board as well as the part of the circuit board edge connector to be connected to the electrical connector located on the other side of the second circuit board, are constituted by separate electrical connectors.

13 Claims, 1 Drawing Sheet

PRINTED CIRCUIT BOARD CONNECTOR

Figure 1:
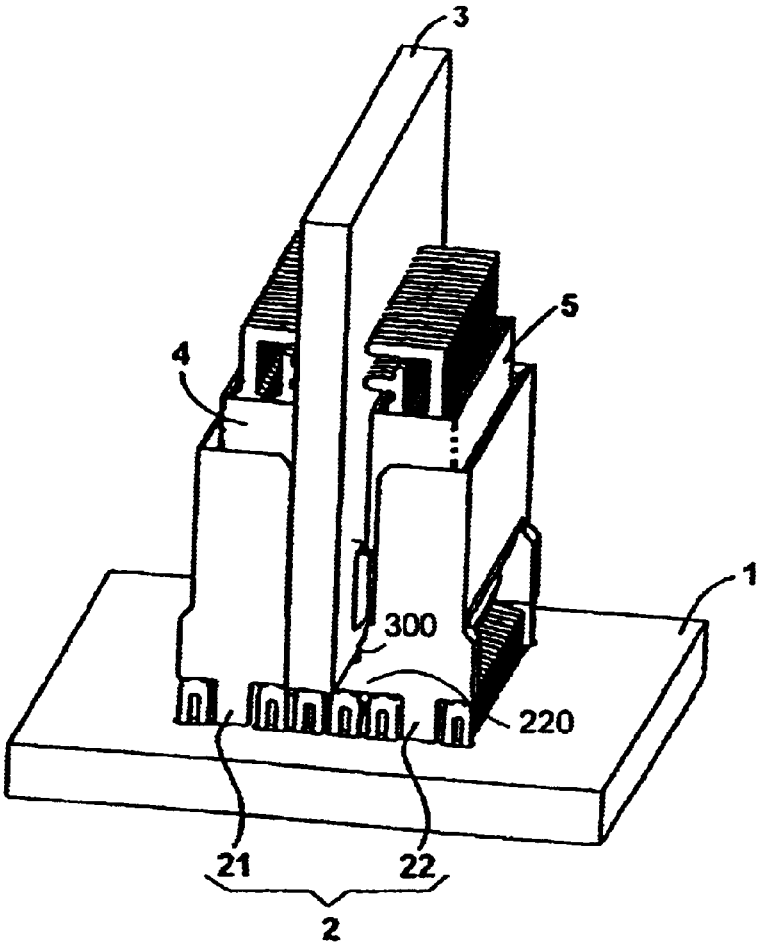

The present invention relates to a device according to the generic clause of claim 1, i.e. to a circuit board edge connector for connecting a first circuit board and a second circuit board adapted to be connected thereto substantially perpendicularly thereto, the circuit board edge connector being mounted on the first circuit board and the circuit board edge connector being designed such that it may be contacted with electrical connectors provided on opposite sides of the second circuit board.

Circuit board edge connectors designed to be contacted with electrical connectors located on opposite sides of a circuit board are necessary because of the ever increasing number of contacts required of circuit board edge connectors; via electrical connectors provided on both sides of a circuit board, it is possible—in relation to the length of the electrical connectors (of the circuit board)—to accommodate more contacts as compared to the case where an electrical connector is provided on only one side of the circuit board.

Due to the very large number of as a rule very densely arranged contacts through which the circuit board edge connectors can be contacted with the circuit boards to be connected thereto and with the circuit board carrying the same, the manufacture of such circuit board edge connectors requires an utmost of precision. This holds in particular if the connection between the circuit board edge connector and the circuit board supporting the same is effected in accordance with an SMT process (the circuit board edge connector is a surface-mounted circuit board edge connector). The same holds analogously for the circuit board to be mated with the circuit board edge connector and for the assembly of the electrical connectors provided thereon. Irrespective of this, circuit board edge connectors of the type indicated at the outset can be handled with great difficulties only.

It is thus an object of the present invention to develop the circuit board edge connector according to the generic clause of claim 1 such that the same can be manufactured and handled relatively easily also with the highest requirements as to quality and reliability.

This object is met according to the invention by the feature claimed in the characterizing clause of claim 1.

Said feature provides that the part of the circuit board edge connector to be connected to the electrical connector located on one side of the second circuit board as well as the part of the circuit board edge connector to be connected to the electrical connector located on the other side of the second circuit board, are constituted by separate electrical connectors.

Such a division of the circuit board edge connector into a plurality of separate partial units turns out to be advantageous in several respects: on the one hand, the thus required tolerances (such as the coplanar arrangement of the terminals required in SMT processes) can be observed more easily, on the other hand, variable parameters (such as different thicknesses of the circuit board to be inserted into the circuit board edge connector) may be taken into consideration with less expenditure, and finally the smaller partial units can be handled more easily (e.g. by automatic component inserting machines).

The claimed circuit board edge connector thus can be manufactured and handled relatively easily also with the highest requirements as to quality and reliability.

Advantageous developments of the invention are indicated in the dependent claims, the following description and the figures.

Figure 2:
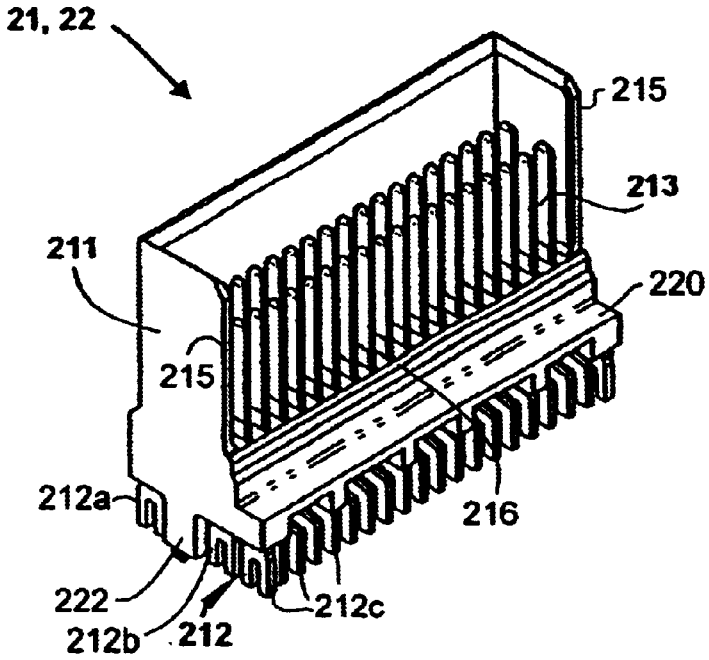

The invention will be described in more detail hereinafter by way of embodiments with reference to the figures in which FIG. 1 shows a perspective view of an arrangement in which two circuit boards are connected to each other via the circuit board edge connector described in more detail hereinafter, and FIG. 2 shows a perspective view of one of the partial units of which the circuit board edge connector according to FIG. 1 is comprised.

The circuit board edge connector described in more detail hereinafter serves for connecting a first circuit board and a second circuit board adapted to be mated therewith perpendicularly thereto.

The first circuit board may be, for example, a so-called back panel circuit board—or in more general terms—a module carrier; the second circuit board may be, for example, a plug-in card to be inserted into the back panel circuit board or—in more general terms—a module to be inserted into the module carrier.

The circuit board edge connector in consideration is mounted on the first circuit board and designed to establish contact with electrical connectors located on opposite sides of the second circuit board.

FIG. 1 shows the state in which the first circuit board and the second circuit board are connected via such a circuit board edge connector. The first circuit board is designated 1, the circuit board edge connector mounted thereon is designated 2, the second circuit board is designated 3, and the electrical connectors provided on the latter are designated 4 and 5.

The circuit board edge connector 2 distinguishes itself in that it consists of a plurality of separate partial units. The separate partial units are separate electrical connectors 21 and 22 of which one (electrical connector 21) is designed to be contacted with the electrical connector (electrical connector 4) located on one side of the second circuit board 3, while the other one thereof (electrical connector 22) is designed to be contacted with the electrical connector (electrical connector 5) located on the other side of the second circuit board 3. These electrical connectors 21 and 22 are separate individual parts that can be mounted on the first circuit board 1 independently of each other.

In the embodiment illustrated, the electrical connectors 21, 22 are of identical construction and are arranged opposite each other rotated by 180°.

A single one of the electrical connectors 21, 22 is shown in FIG. 2.

The electrical connectors 21, 22 consist of a housing 211, first contact elements 212 for connection to the first circuit board 1 and second contact elements 213 for connection to the second circuit board 3.

In the embodiment illustrated, the electrical connectors 21, 22 are surface-mounted electrical connectors. I.e. the first contact elements 212 are designed to be connected (soldered) to the first circuit board using an SMT process. However, it is to be pointed out here that the invention is not restricted thereto. The connection between the electrical connectors 21, 22 and the first circuit board may also be established in any arbitrary other manner.

The second contact elements 213 are contact blades arranged in two juxtaposed rows. I.e. the electrical connectors 21, 22 are dual-line male multipoint connectors. Accordingly, the electrical connectors 4, 5 of the second circuit board 3 are dual-line female multipoint connectors. However, the invention is not restricted thereto, either. The second contact elements 213 of the electrical connectors 21, 22 may also be of arbitrary other type and arrangement.

As shown in FIG. 2, each housing 21, 22 includes an open face defined by side edges 215 and lower edge 216, which opens on to the array of contacts 213. Connector housing 211 further includes a housing extension portion 220, which projects outwardly away from side edges 215 and lower edges 216. As also shown best in FIG. 2, three rows of contacts are formed with a row of contacts 212*a* and 212*b* being positioned on opposite sides of wall 222 and a row of contacts 212*c* being positioned under extension portion 220.

The electrical connectors 21, 22 of the type of FIG. 2 may be mounted on the first circuit board independently of each other. In particular, it is possible without any problem to vary the distance in which they are arranged parallel to each other. The circuit board edge connector 2 of the first circuit board 1 thus may be matched to the particular thickness of the second circuit board 3 in very simple manner. Matching of the circuit board edge connector 2 to the thickness of the second circuit board 3 just requires corresponding positioning of the solder pads where the first contact elements 212 of the electrical connectors are soldered. If the circuit board edge connector were designed, as before, as a contiguous (one-piece) unit, it would be necessary to provide for different circuit board edge connectors to accommodate different thicknesses of the second circuit board 3.

However, the division of the circuit board edge connector into separate partial units turns out advantageous in other respects as well.

The partial units, strictly speaking the electrical connectors 21, 22, each have a lesser number of contact elements (in the embodiment illustrated only half as many contact elements each) than the circuit board edge connector 2. This turns out to be advantageous especially with regard to the first contact elements 212. The latter (due to the comparatively small number thereof) can be aligned in coplanar manner with relatively little expenditure, which is of utmost importance if SMT processes are used for connection to the first circuit board 1; as is known, the terminals of components to be mounted using an SMT process must be aligned in coplanar fashion.

Apart from this, the separate partial units of the circuit board edge connector, due to the comparatively small size, can be handled in considerably easier manner (e.g. by automatic component inserting machines) than a circuit board edge connector in the form of a contiguous unit.

In the embodiment shown, the partial units (electrical connectors 21, 22) of the circuit board edge connector are of identical construction. Though this proves to be especially advantageous, as only a minimum number of different parts needs to be manufactured and mounted, it is not, cogently required. The electrical connectors 21, 22 may also be different electrical connectors. For example, the first electrical connector 21 may also be a dual-line male multipoint connector and the second electrical connector a four-line male multipoint connector.

With respect now to FIGS. 1 and 2, as disclosed on printed circuit board 1, connectors 21 and 22 define a slot 300 for receiving printed circuit board 3 defined intermediate side edges 215 of each electrical connector, as well as above each extension portion 220 of connectors 21, 22. Both the open face defined by the opening at side edges 215 and 216 and the row of terminals 212*c* under extension portion 220 maximize the density provided by the electrical connection of connectors 2, 4, 5.

Irrespective of the particulars of practical realization, the circuit board edge connector described permits comparatively easy manufacture and handling thereof also with the highest requirements concerning quality and reliability.

What is claimed is:

1. A circuit board edge connector for connecting a first circuit board and a second circuit board adapted to be connected thereto substantially perpendicularly thereto, the circuit board edge connector being mounted on the first circuit board and the circuit board edge connector being designed such that it may be contacted with electrical connectors provided on opposite sides of the second circuit board, the part of the circuit board edge connector to be connected to the electrical connector located on one side of the second circuit board as well as the part of the circuit board edge connector to be connected to the electrical connector located on the other side of the second circuit board are constituted by separate electrical connectors, each said electrical connector comprising an insulative body portion and an extension portion, extending transverelly therefrom with each said insulative body portion comprising an open face above said extension portion, exposing electrical terminal portions which interconnect with said circuit board edge connectors.

2. A circuit board edge connector according to claim 1, wherein the distance between the separate electrical connectors is made dependent upon the thickness of the second circuit board.

3. A circuit board edge connector according to claim 1, wherein each said electrical connector comprises a plurality of rows of electrical terminals, with at least some of said terminals positioned below said insulative body portion, and some of said terminals positioned below said extension portions.

4. A, circuit board edge connector according to claim 1, wherein the separate electrical connectors are of identical construction.

5. A circuit board edge connector according to claim 4, wherein the separate electrical connectors are arranged opposite each other rotated by 180°.

6. A printed circuit board assembly, comprising:

a first printed circuit board;

a first electrical connector assembly, mounted to said first printed circuit board, said first electrical connector assembly being comprised of two housing portions, each housing portion having an insulative body portion and an extension portion extending transversely therefrom, said two housing portions being positioned on said first printed circuit board, with said housing extension portions adjacent to each other to define an orthogonal receiving slot above said housing extension portions and intermediate said insulative body portions, said first electrical connector having electrical contacts comprised of printed circuit portions for contacting with said first printed circuit board, with at least some of said contacts positioned below said housing body portion and some of said contacts below said housing extension portion, and connector contacting portions;

a second printed circuit board; and a second electrical connector assembly mounted to said second printed circuit board, for receipt within said orthogonal slot and into electrical contact with said connector contacting portions.

7. A circuit board edge connector according to claim 6, wherein the distance between the separate electrical connectors is made dependent upon the thickness of the second circuit board.

8. A circuit board edge connector according to claim 6, wherein each said electrical connector insulative body portion comprises an open face above said extension portion, exposing electrical terminal portions which interconnect with said circuit board edge connectors.

9. A circuit board edge connector according to claim 6, wherein said housing portions, prior to mounting to said first printed circuit board are movable relative to each other to define a slot width for said orthogonal slot.

10. A circuit board edge connector according to claim 9, wherein the two opposing housings have surface mount type electrical connections adjacent a mounting face, for mounting to the first printed circuit board.

11. A circuit board edge connector according to claim 10, wherein the two opposing housings have electrical terminal portions, in common with said surface mount contact portions, for mating with an electrical connector mounted to said second printed circuit board.

12. A circuit board edge connector according to claim 6, wherein the second electrical connector is comprised of printed circuit board contacts for mounting to the second printed circuit board and for contacting said connector contacting portions of said first electrical connector.

13. A circuit board edge connector, according to claim 12, wherein said second connector assembly is comprised of two separate housing portions mounted on opposite side of said second printed circuit board.

* * * * *

UNITED STATES PATENT AND TRADEMARK OFFICE

CERTIFICATE OF CORRECTION

PATENT NO. : 6,736,647 B1
DATED : May 18, 2004
INVENTOR(S) : Eric Gillenberg

It is certified that error appears in the above-identified patent and that said Letters Patent is hereby corrected as shown below:

Column 4,
Line 18, delete “transverelly” and insert -- transversely --
Line 33, delete “A,” and insert -- A --

Signed and Sealed this

Thirtieth Day of November, 2004

JON W. DUDAS
*Director of the United States Patent and Trademark Office*